US011708630B2

(12) United States Patent
Thomas et al.

(10) Patent No.: US 11,708,630 B2
(45) Date of Patent: Jul. 25, 2023

(54) TITANIUM ALLOY WITH MODERATE STRENGTH AND HIGH DUCTILITY

(71) Applicant: Titanium Metals Corporation, Henderson, NV (US)

(72) Inventors: Roger Owen Thomas, Swansea (GB); Steven James, Henderson, NV (US); Paul Garratt, Swansea (GB); Matthew Thomas, Swansea (GB)

(73) Assignee: Titanium Metals Corporation, Henderson, NV (US)

( * ) Notice: Subject to any disclaimer, the term of this patent is extended or adjusted under 35 U.S.C. 154(b) by 406 days.

(21) Appl. No.: 16/583,036

(22) Filed: Sep. 25, 2019

(65) Prior Publication Data

US 2020/0095665 A1 Mar. 26, 2020

Related U.S. Application Data

(60) Provisional application No. 62/736,229, filed on Sep. 25, 2018.

(51) Int. Cl.
*C22F 1/18* (2006.01)
*C22C 14/00* (2006.01)

(52) U.S. Cl.
CPC ..... *C22F 1/183* (2013.01); *C22C 14/00* (2013.01)

(58) Field of Classification Search
CPC ..... C22F 1/183; C22C 14/00
See application file for complete search history.

(56) References Cited

U.S. PATENT DOCUMENTS

| | | | | |
|---|---|---|---|---|
| 2,893,864 | A | 7/1959 | Harris et al. | |
| 3,802,877 | A | 4/1974 | Parris et al. | |
| 9,677,162 | B2 | 6/2017 | Gloriant et al. | |
| 10,000,838 | B2 | 6/2018 | Thomas et al. | |
| 2016/0108508 | A1* | 4/2016 | Thomas | C22F 1/183 420/420 |

FOREIGN PATENT DOCUMENTS

| | | | | |
|---|---|---|---|---|
| EP | 3276018 | | 1/2018 | |
| GB | 1479855 | A * | 7/1977 | C22C 14/00 |
| RU | 2412269 | C1 | 2/2011 | |
| RU | 2610657 | | 2/2017 | |
| RU | 2610657 | C1 * | 2/2017 | C22C 14/00 |

(Continued)

OTHER PUBLICATIONS

Dialog machine translation of RU 2610657 C1 (Year: 2021).*

(Continued)

*Primary Examiner* — Anthony J Zimmer
*Assistant Examiner* — Ricardo D Morales
(74) *Attorney, Agent, or Firm* — Burris Law, PLLC

(57) ABSTRACT

A titanium alloy composition is provided. In weight percent (wt. %), the alloy includes 5.7 to 8.0% vanadium, 0.5 to 1.75% aluminum, 0.25 to 1.5% iron, 0.1 to 0.2% oxygen, up to 0.15% silicon, up to 0.1% carbon and less than 0.03% nitrogen is provided. In one form, the titanium alloy has a 0.2% yield strength between 600 to 850 MPa, an ultimate tensile strength between 700 to 950 MPa, a percent elongation to failure between 20 to 30%, a percent reduction in area between 40 to 80%, a Charpy U-notch impact energy between 30 to 70 J, and/or a Charpy V-notch impact energy between 40 to 150 J.

8 Claims, 1 Drawing Sheet

(56) References Cited

FOREIGN PATENT DOCUMENTS

| | | |
|---|---|---|
| WO | 2015116567 | 8/2015 |
| WO | 2018162920 | 9/2018 |

OTHER PUBLICATIONS

Lampman, S. "Wrought Titanium and Titanium Alloys" (1990) ASM Handbook, vol. 2: Properties and Selection: Nonferrous Alloys and Special-Purpose Materials, ASM Handbook Committee, p. 592-633, DOI: 10.31399/asm.hb.v02.a0001081 (Year: 1990).*

International Search Report and Written Opinion for International Application PCT/US2019/053007, dated May 7, 2020.

Office Action issued in corresponding CN Application No. 201980063281.6, dated Jan. 25, 2022.

Office Action issued in corresponding RU Application No. 2021111377/05, dated Feb. 13, 2023, and English Translation, 19 pages.

* cited by examiner

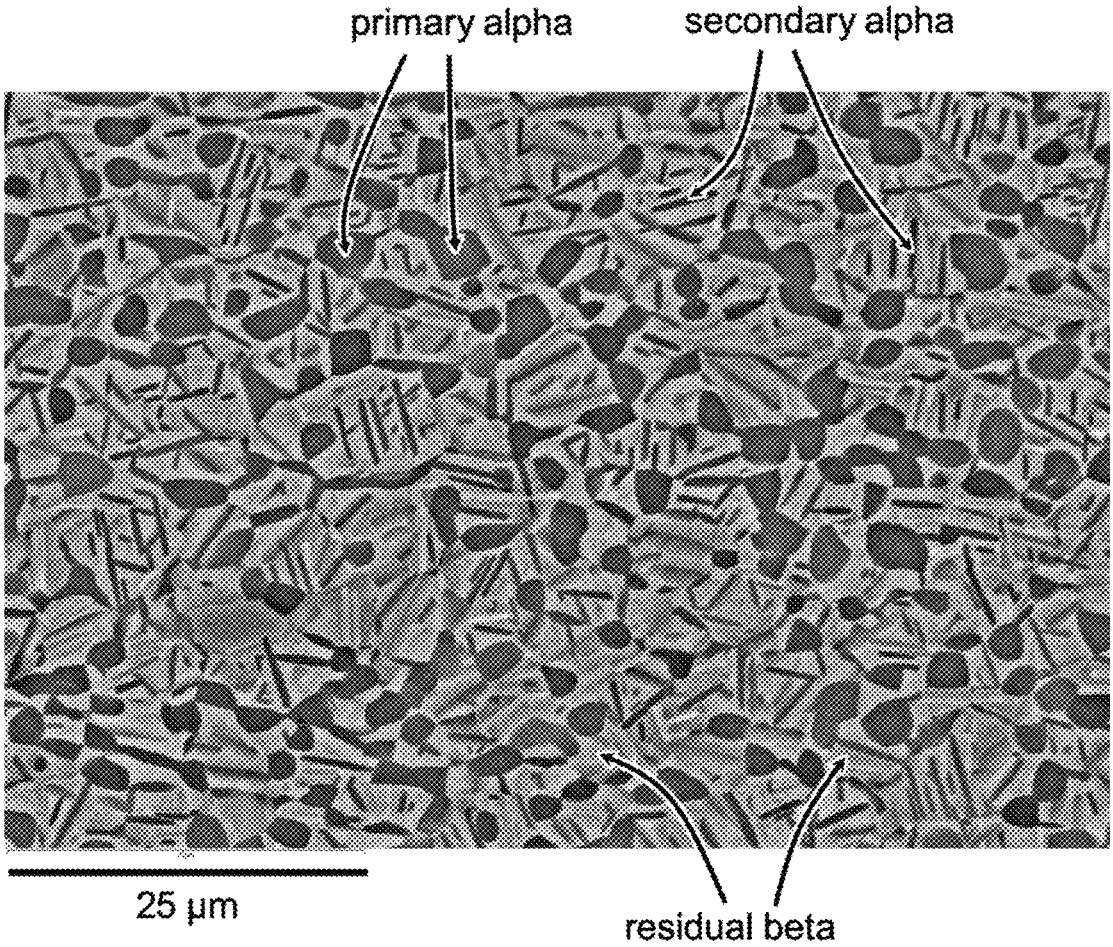
primary alpha
secondary alpha
25 µm
residual beta

TITANIUM ALLOY WITH MODERATE STRENGTH AND HIGH DUCTILITY

CROSS-REFERENCE TO RELATED APPLICATIONS

This application claims priority to and the benefit of provisional application 62/736,229 filed on Sep. 25, 2018. The disclosure of the above application is incorporated herein by reference.

FIELD

The present disclosure relates to titanium alloys, and more particularly to titanium alloys with enhanced strength and comparable ductility to commercially available alloys.

BACKGROUND

The statements in this section merely provide background information related to the present disclosure and may not constitute prior art.

Titanium base alloys (referred to herein simply as "titanium alloys"), most commonly the titanium alloy described as Ti-6Al-4V (containing 6% aluminum and 4% vanadium by weight percent), are commonly used for aircraft structures and other articles requiring higher strength to weight ratios provided by steels and other engineering alloys. Titanium alloys including vanadium, aluminum, and iron as constituents, with other elements included optionally, may be used to produce high strength titanium alloys (compared to the industry benchmark, Ti-6Al-4V), according to U.S. Pat. No. 3,802,877 ("the '877 Patent"). However, the '877 Patent discloses comparatively high contents of alloying elements in order to produce metastable beta titanium alloys with a yield strength (YS) exceeding 1038 MPa, which results in higher costs.

The present disclosure addresses these higher costs, among other issues related to high strength titanium alloys.

SUMMARY

In one form of the present disclosure, a titanium alloy comprising (in wt. %) 5.7 to 8.0% vanadium, 0.5 to 1.75% aluminum, 0.25 to 1.5% iron, 0.1 to 0.2% oxygen, up to 0.15% silicon, up to 0.1% carbon and less than 0.03% nitrogen is provided. In some variations of the present disclosure, the vanadium is between 5.9 to 8%, for example, between 6.1 and 8%. In another form, the vanadium is between 6.8 to 7.8%, the aluminum is between 0.9 to 1.5%, the iron is between 0.5 to 1.1%, the oxygen is between 0.12 to 0.19%, and the silicon is up to 0.12%. In one variation, the vanadium is 7.3%, the aluminum is 1.2%, the iron is 0.8%, the silicon is 0.05%, and the oxygen is 0.16%. In yet another variation, the titanium alloy has 7.2% vanadium, 1.2% aluminum, 0.8% iron, 0.15% oxygen, 0.05% silicon, and carbon and nitrogen are reduced to impurities.

In one form, the titanium alloy has a yield strength (YS) at 0.2% plastic deformation (i.e., the 0.2% YS) between 600 to 850 MPa, an ultimate tensile strength between 700 to 950 MPa, a percent elongation to failure between 20 to 30%, a percent reduction in area between 40 to 80%, Charpy U-notch impact energy between 30 to 70 J, and/or a Charpy V-notch impact energy between 40 to 150 J. For example, the titanium alloy has a 0.2% yield strength between 650 to 850 MPa, an ultimate tensile strength between 750 to 950 MPa, a percent elongation to failure between 22 to 30%, a percent reduction in area between 55 to 75%, Charpy U-notch impact energy between 40 to 60 J, and/or a Charpy V-notch impact energy between 60 to 100 J.

In another form of the present disclosure, a method for manufacturing a titanium alloy is provided. The method includes melting and forming an ingot with a chemical composition within the range according to the present disclosure comprising (in wt. %) 5.7 to 8% vanadium, 0.5 to 1.75% aluminum, 0.25 to 1.5% iron, 0.1 to 0.2% oxygen, up to 0.15% silicon, up to 0.1% carbon and less than 0.03% nitrogen. A variation of the method includes beta forging and rolling the ingot and forming an intermediate product (e.g., a plate or slab), alpha beta rolling the plate or slab and forming an article, alpha beta solution heat treating (SHT) the article, and stress relieving the SHT article. In some forms of the present disclosure, the stress relieved article may have a 0.2% yield strength between 600 to 850 MPa, an ultimate tensile strength between 700 to 950 MPa, a percent elongation to failure between 20 to 30%, a percent reduction in area between 40 to 80%, Charpy U-notch impact energy between 30 to 70 J, and/or a Charpy V-notch impact energy between 40 to 150 J. For example, the stress relieved article may have a 0.2% yield strength between 650 to 850 MPa, an ultimate tensile strength between 750 to 950 MPa, a percent elongation to failure between 22 to 30%, a percent reduction in area between 55 to 75%, Charpy U-notch impact energy between 40 to 60 J, and/or a Charpy V-notch impact energy between 60 to 100 J.

In one form of the present disclosure, the method includes re-heating the plate for sizing, straightening or flattening, and stress relieving the article at a temperature in the range 500° C. to 650° C. Also, the Charpy impact energy of the article is increased by alpha beta rolling the plate or slab to reduction of area of at least 50% followed by re-heating the article for sizing, straightening, flattening, and stress relieving the article at a temperature in the range 500° C. to 650° C. In the alternative, or in addition to, the tensile ductility of the article is increased by alpha beta working the plate or slab to a minimum of 50% reduction of area, reheating the plate to a temperature 50° C. to 150° C. below the beat transus for sizing, straightening or flattening the article, solution heat treating the article at a temperature 30° C. to 100° C. below the beta transus, cooling at a desired rate such that an improved strength is obtained, and stress relieving in the range 500° C. to 650° C.

The vanadium in one form of the titanium alloy is between 5.7 to 8.0%, for example, between 5.9 to 8.0%. In one form, the vanadium is between 6.8 to 7.8%, the aluminum is between 0.9 to 1.5%, the iron is between 0.5 to 1.1%, the oxygen is between 0.12 to 0.19%, and the silicon is up to 0.12%. In one variation of the present disclosure, the vanadium is 7.3%, the aluminum is 1.2%, the iron is 0.8%, the silicon is 0.05%, and the oxygen is 0.16%. In another form of the present disclosure, the titanium alloy has 7.2% vanadium, 1.2% aluminum, 0.8% iron, 0.15% oxygen, 0.05% silicon, and carbon and nitrogen are reduced to impurities.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which:

FIG. 1 is a backscatter electron image of an alpha beta titanium alloy according to the teachings of the present disclosure.

DETAILED DESCRIPTION

The following description is merely exemplary in nature and is not intended to limit the present disclosure, application, or uses. It should be understood that throughout the drawings, corresponding reference numerals indicate like or corresponding parts and features. Examples are provided to fully convey the scope of the disclosure to those who are skilled in the art. Numerous specific details are set forth such as types of specific components, devices, and methods, to provide a thorough understanding of variations of the present disclosure. It will be apparent to those skilled in the art that specific details need not be employed and that the examples provided herein, may include alternative embodiments and are not intended to limit the scope of the disclosure. In some examples, well-known processes, well-known device structures, and well-known technologies are not described in detail.

The present disclosure generally relates to titanium (Ti) alloys for use in applications in which a desired performance relates to the energy absorbed during deformation of the part, including impact, explosive blast, or other forms of shock loading. The titanium alloy made and used according to the teachings contained herein provides a performance gain and/or cost savings when used in such harsh applications. The titanium alloys are described throughout the present disclosure in conjunction with use in an aircraft engine containment casing in order to more fully illustrate the teachings of the present disclosure. When used in an aircraft (e.g., jet) engine containment casing, the titanium alloy typically takes the form of a ring that surrounds the fan blade and maintains containment of the blade in the event of an unsuccessful application of that component. The incorporation and use of the titanium alloy in conjunction with other types of applications in which the alloy may be exposed to impact, explosive blast, or other forms of shock loading is within the scope of this disclosure.

The titanium alloys prepared according to the teachings of the present disclosure possess a balance of several traits or properties that provide an all-around improvement over conventional titanium alloys that are commonly used for engine containment. All properties are obtained from samples prepared using production simulated processing techniques and under various heat treatment conditions. The properties and associated ranges exhibited by the titanium alloys of the present disclosure include: (a) a yield strength (YS) between 600 and 850 MPa, (b) an ultimate tensile strength between 700 and 900 MPa, (c) percent elongation to failure between 20 to 30%, and (d) a percent reduction in area between 40 to 80%. The titanium alloys exhibit properties that are within the ranges described above because many of these traits are influenced by one another. For example, the mechanical properties and texture properties exhibited by the titanium alloys influence the ballistic impact resistance of the alloy.

In comparison to prior titanium alloys, such as a Ti-6Al-4V alloy, that are used in applications which expose the alloy to impact, explosive blast, or other forms of shock loading, the titanium alloys of the present disclosure provide both a performance gain and a manufacturing cost savings. The titanium alloy formulations of the present disclosure exhibit excellent energy absorption under high strain rate conditions, as well as excellent workability and machinability. This combination of performance and manufacturing capability enables the design of containment systems and functional components formed from these titanium alloys in which containment of high velocity or ballistic impact is of importance at the lowest practical cost. Also, many titanium alloys, such as the Ti-6Al-4V alloy, have a higher aluminum equivalent which promotes <a>-slip as the primary deformation mechanism. In comparison, the aluminum equivalent in the present disclosure is much lower and thereby promotes alternative deformation mechanisms such as twinning and <c+a>-slip that facilitate improved machinability and rapid energy absorption (e.g., see *The effect of aluminium on twinning in binary alpha-titanium*, Fitzner et al., Acta Materialia 103:341-351, January 2016, and *The Effect of Aluminium on Deformation by Twinning in Alpha Titanium*, Fitzner et al., Plasticity, 2013).

The titanium alloys according to the present disclosure may also be selected for use on economic grounds, due to their advantages in component manufacture, where their strength and/or corrosion resistance is adequate for the application, even where blast, shock loading, or ballistic impact are not key design criterion.

The present disclosure describes titanium alloys with enhanced ductility compared to Ti-6Al-4V alloys and enhanced strength compared to other commercial titanium alloys. Particularly, the present disclosure describes titanium alloys with lower levels of aluminum and higher levels of V compared to Ti-6Al-4V alloys and other commercial titanium alloys. The titanium alloys described herein exhibit greater ductility and lower strength, e.g., ductility between 22% to 30% and yield strength between 700 MPa to 830 MPa in the annealed and air cooled (AC) condition, and hence generally more ductile and lower strength than Ti-6Al-4V alloys. Also, the titanium alloys described herein exhibit about the same ductility and greater strength than other commercial titanium alloys. The alloys described in the present disclosure have advantages in "single loading to failure" applications where the desired component is determined by high strain rate events such as blast and impact damage, and specific strength is to be balanced with material parameters such as ductility and Charpy impact energy.

Regarding commercially available titanium alloys, U.S. Pat. No. 10,000,838, which is commonly assigned with the present disclosure and is incorporated herein by reference, discloses a titanium alloy, commercially known as the Ti-407 alloy and sold under the trademark TIMETAL® 407 alloy, with a nominal composition (wt. %) of about Ti, 0.85 Al, 3.9 V, 0.25 Si, 0.25 Fe, 0.15 O, which allows components for 'single loading to failure' applications to be manufactured to achieve improved performance at lower cost. The present disclosure includes titanium alloys with a yield strength intermediate between that of the Ti-407 alloy and that the Ti-6Al-4V alloy, and ductility generally equal to the Ti-407 alloy and greater than the Ti-6Al-4V alloy.

In one form of the present disclosure, compositions of the titanium alloys comprising (in weight %) 5.7 to 8.0% V, 0.5 to 1.75% Al, 0.25 to 1.5% Fe, 0.1 to 0.2% 0, and up to 0.15% Si, balance titanium and unavoidable impurities. For example, compositions of the titanium alloys disclosed in the present disclosure may comprise (in weight %) 6.8 to 7.8% V, 0.9 to 1.5% Al, 0.5 to 1.1% Fe, 0.12 to 0.19% 0, and up to 0.12% Si, balance titanium and unavoidable impurities. In one form of the present disclosure, the titanium alloy may have a nominal composition (in weight %) of Ti, 7.3% V, 1.2% Al, 0.8% Fe, 0.05% Si, 0.16% 0, and unavoidable impurities.

In another form of the present disclosure, compositions of the titanium alloys comprise (in weight %) 5.7 to 8.0% V, 0.5 to 1.75% Al, 0.25 to 1.5% Fe, 0.1 to 0.2% 0, up to 0.15% Si, up to 0.5% Sn, up to 0.25% Mo, and up to 0.25% Cr, balance titanium and unavoidable impurities.

The titanium alloys disclosed herein may be processed as an alpha beta titanium alloy. That is, the titanium alloys disclosed herein are melted by any of the conventional, industrially established melting methods for titanium alloys, then beta forged and/or rolled, followed by forging and/or rolling in the alpha+beta phase range of temperature, and heat treatment in the alpha beta phase range. The ductility of the alloy may be improved by forging and/or rolling to give a reduction in cross section of at least 50% in the alpha+beta phase range of temperature, followed by stress relief heat treatment, optionally preceded by solution heat treatment. The resulting microstructure comprises a fine bimodal microstructure of primary alpha phase in a matrix of transformed beta phase (secondary alpha phase), with some residual beta phase a shown in FIG. 1.

In one form of the present disclosure, the titanium alloys provide enhanced strength (e.g., 600 MPa minimum 0.2% YS) compared with the Ti-407 alloy (550 MPa minimum 0.2% YS) while maintaining approximately equivalent ductility and Charpy impact energy to the Ti-407 alloy. It should be understood that such an increase in strength without a decrease in ductility is a surprising result, since in titanium alloys, an increase in strength is generally accompanied with a reduction in ductility and Charpy impact energy.

The strength of the titanium alloys disclosed herein, like many other titanium alloys, may depend substantially on the last thermal operation in the alpha beta phase temperature range, and the cooling rate from that operation. Particularly, quenching from the last thermal operation in the alpha beta phase temperature range may produce fine martensitic secondary alpha that may provide higher strength. In one example, a 28 millimeter (mm) square block was solution heat treated, oil quenched, and then stress relieved, the block exhibited a 0.2% yield strength of 940 MPa. Also, sufficiently slow cooling from the last thermal operation in the alpha beta phase temperature range results in a bimodal microstructure of primary alpha and retained beta phases that results in lower strength, higher ductility and Charpy impact energy, and lower Elastic Modulus. Non-limiting examples of cooling rates for the sufficiently slow cooling from the last thermal operation in the alpha beta phase temperature range include cooling rates less than or equal to 200° C./min which can include air cooling.

It should be understood that when vanadium (V) and iron (Fe) are added to titanium alloys, they act as beta phase stabilizers. Particularly, V is an isomorphous beta stabilizer with some solubility in alpha phase titanium and Fe is a eutectic forming beta stabilizer which exhibits a high diffusion rate and low solubility in alpha phase titanium. Accordingly, when the titanium alloys disclosed herein are heat treated in the alpha plus beta phase temperature range, Fe partitions substantially to the beta phase. While V and Fe both contribute (either independently or in combination) to the strength of the titanium alloys disclosed herein via solid solution strengthening, V and Fe may assist in refining the transformation product upon cooling from the beta phase region to the alpha phase region at a given cooling rate and lower quantities of V and Fe in the titanium alloys disclosed herein may be derived from a desired lower strength level for the alloys. Also, V and Fe enhance the ductility of the titanium alloys disclosed herein by promoting retained beta phase in the microstructure since the beta body centered cubic phase accommodates large strains, even at high strain rate, compared with the alpha hexagonal phase. Accordingly, a lower level (wt. %) of V in the titanium alloys disclosed herein is 5.5%, 5.7%, 6.0%, 6.4% or 6.8%. Also, a lower level of (wt. %) of Fe in the titanium alloys disclosed herein is 0.25%, 0.3%, 0.4%, or 0.5%.

In the alternative, if V and Fe contents of a titanium alloy are too high, the ductility and Charpy impact energy of the alloy may deteriorate, and under certain conditions, slow cooling from heat treatment may result in the retention of a high proportion of beta phase and an alloy with an undesirably low elastic modulus. Also, subsequent aging heat treatment presents the hypothetical hazard of embrittlement by omega phase formation, particularly if the aluminum content is at the low end of the range. In addition, high Fe contents in titanium alloys present manufacturing challenges, specifically chemical segregation during ingot solidification, and ingot surface tearing during drawdown from ingot casting by cold hearth melting methods. By these considerations, the titanium alloys disclosed herein have maximum V and Fe contents to attempt to avoid such issues. Accordingly, a maximum content (wt. %) of V in the titanium alloys disclosed herein is 8.0%, 7.8%, 7.5% or 7.3%. Also, a maximum content of (wt. %) of Fe in the titanium alloys disclosed herein is 1.5%, 1.25%, 1.1%, or 0.8%.

It should also be understood that aluminum (Al) and oxygen (O) are known in the art as alpha phase stabilizers in titanium alloys. Also, Al is a substitutional alloying element, and O is an interstitial alloying element. In the titanium alloys disclosed herein, Al and O are strengthening elements, particularly in strengthening the alpha phase, and the minimum contents of these elements may be derived from a desired minimum strength level of the alloy. Accordingly, a minimum content (wt. %) of Al in the titanium alloys disclosed herein is 0.5%, 0.7%, 0.9%, 1.1% or 1.2%. Also, a minimum content of (wt. %) of O in the titanium alloys disclosed herein is 0.1%, 0.12%, 0.14%, or 0.16%.

In the alternative, if the Al and O contents of a titanium alloy are too high, the ductility and Charpy impact energy of the alloy may deteriorate. The Charpy impact energy is particularly sensitive to oxygen content with some experimental compositions disclosed in the present disclosure exhibiting good ductility in room temperature tensile testing at standard strain rates, but poor Charpy impact energy. Such a result is understood to be a consequence of the strain rate dependent interaction between interstitial alloying elements and dislocations in titanium alloys and the maximum Al and O contents may be set based on these considerations. Accordingly, a maximum content (wt. %) of Al in the titanium alloys disclosed herein is 1.75%, 1.6%, 1.5%, 1.4% or 1.2%. Also, a maximum content (wt. %) of O in the titanium alloys disclosed herein is 0.2%, 0.19%, 0.18%, or 0.16%.

Silicon (Si) is known to add strength to titanium alloys by a combination of solution strengthening and formation of precipitates of titanium silicides. However, Si may have a significant negative affect on the Charpy impact energy. Accordingly, a maximum content (wt. %) of Si in the titanium alloys disclosed herein has been reduced relative to the Si content of the Ti-407 alloy, which has a nominal Si content of 0.25 wt. %, and is 0.15%, 0.12%, 0.10%, 0.075%, or 0.05%. In one form of the present disclosure, a nominal Si content is included in recognition of the occurrence of Si in some raw materials and the desire to regulate this impurity.

Carbon (C) and Nitrogen (N) are also interstitial impurities which, like oxygen and silicon, have a sensitive effect on the Charpy impact energy of titanium alloys. Even at levels where C and N do not significantly affect the ductility of titanium alloys as measured by room temperature tensile testing at standard strain rates, C and N may result in a reduction of Charpy impact energy. Accordingly, a maximum content (wt. %) of C in the titanium alloys disclosed herein is 0.1%, 0.08%, 0.06%, 0.04%, or 0.02%. Also, a maximum content (wt. %) of N in the titanium alloys disclosed herein is 0.03% (300 wt. ppm), 0.02%, or 0.01%. Also, a total content of total content C+O+Si has an effect of Charpy impact energy of titanium alloys. For example, in some variations of the present disclosure, titanium alloys with a total content of C+O+Si of less than or equal to 0.4% have U-notch Charpy impact energies of at least 25 J.

It should be understood that other elements in small quantities (e.g., less than 1%, less than 0.5%, or less than or equal to 0.25%) can be present in the titanium alloys and not fall outside the scope of the present disclosure. For example, beta stabilizers such as molybdenum (Mo) and chromium (Cr) may be present in the alloy up to 0.5% Mo and 0.5% Cr. In at least one variation, the titanium alloys include up to 0.25% Mo and/or up to 0.25% Cr. Also, tin (Sn) may be present in the titanium alloys disclosed herein up to 1.0%. In another variation, the titanium alloys include up to 0.5% Sn.

The following specific examples are given to illustrate the composition, properties, and use of titanium alloys prepared according to the teachings of the present disclosure and should not be construed to limit the scope of the disclosure. Those skilled in the art, in light of the present disclosure, will appreciate that many changes can be made in the specific examples which are disclosed herein and still obtain alike or similar result without departing from or exceeding the spirit or scope of the disclosure.

Example 1

A series of comparative titanium alloy 0.4 pounds (lbs.) (0.18 kg) 'button' ingots were manufactured by non-consumable argon arc melting, and then converted to 0.5 inch (12.7 mm) square bars by a combination of beta forging and rolling, then alpha beta rolling, followed by alpha beta solution treatment at 25° C. below the beta transus temperature for 1 hour (hr.) and stress relieving at 500° C. for 8 hrs. Chemical compositions (i.e., aim chemical compositions) of the ingots and the results of mechanical testing on the 0.5 inch (12.7 mm) square bars are shown below in Table 1. The "Elong'n 5.65√A" refers to percent elongation of a sample or specimen whose gage length is 5.65 times the square root of its gauge area and the "Elong'n 4D" refers to percent elongation of a sample or specimen whose gage length is 4 times its gauge area.

TABLE 1

| Button ID | ID | Wt % (AIM) Al | V | Fe | Si | C | O | O2 analysed | CHARPY (J) | 0.2% YS (MPa) | UTS (MPa) | Elong'n 5.65√A | Elong'n 4D | R in A |
|---|---|---|---|---|---|---|---|---|---|---|---|---|---|---|
| 2954 | MT6838 | 1 | 4 | 1 | 0.25 | 0.02 | 0.15 | 0.126 | 28 | 656 | 789 | 24 | 27 | 53 |
| 2957 | MT6839 | 1 | 5 | 1 | 0.25 | 0.02 | 0.15 | 0.145 | 27 | 705 | 825 | 23 | 26.5 | 56.5 |
| 2960 | MT6840 | 1 | 4 | 0.8 | 0.5 | 0.1 | 0.15 | 0.128 | 17.5 | 698 | 831 | 22 | 25 | 41 |
| 2692 | MT6841 | 0.5 | 5 | 0.8 | 0.5 | 0.1 | 0.15 | 0.174 | 17.5 | 790 | 905 | 19.5 | 22 | 41 |
| 2971 | MT6842 | | 6 | 1.5 | 0.25 | 0.02 | 0.15 | 0.155 | 21 | 772 | 878 | 19.5 | 22 | 52 |
| 2972 | MT6843 | | 6.5 | 1.5 | 0.25 | 0.02 | 0.15 | 0.182 O2 (0.099 N2) | 16 | 1015 | 1094 | 17.5 | 21 | 46.5 |
| 2973 | MT6844 | | 6 | 1.5 | 0.25 | 0.1 | 0.15 | 0.155 | 19 | 830 | 932 | 18.5 | 22 | 52 |
| 3019 | MT6845 | | 4 | 1.25 | 0.25 | 0.08 | 0.3 | n/a | 19 | 800 | 922 | 22.5 | 26 | 50.5 |
| 3021 | MT6846 | | 4 | 1.25 | 0.25 | 0.1 | 0.1 | 0.106 | 27 | 629 | 767 | 24 | 27.5 | 54.5 |
| 3022 | MT6847 | | 4 | 1.25 | 0.25 | 0.2 | 0.1 | 0.107 | 21.5 | 627 | 768 | 23.5 | 26.5 | 48 |
| 3023 | MT6848 | | 4 | 1.25 | 0.25 | 0.1 | 0.2 | 0.204 | 23 | 720 | 851 | 25 | 28.5 | 51.5 |
| 3024 | MT6849 | | 4 | 1.25 | 0.25 | 0.2 | 0.2 | 0.205 | 14 | 700 | 843 | 23.5 | 26 | 49.5 |
| 3025 | MT6850 | | 4 | 1.25 | 0.25 | 0.2 | 0.3 | 0.305 | 6 | 771 | 918 | 21.5 | 25 | 44 |
| 3026 | MT6851 | | 4 | 1.25 | 0.25 | 0.1 | 0.4 | 0.388 | 18.5 | 845 | 985 | 24 | 27 | 51 |
| 3027 | MT6852 | | 4 | 1.25 | 0.25 | 0.2 | 0.4 | 0.394 | 8 | 841 | 990 | 17.5 | 19.5 | 22 |
| 3029 | MT6854 | | 4 | 1.25 | — | 0.15 | 0.4 | 0.385 | 9.5 | 775 | 932 | 24.5 | 28.5 | 52.5 |

Analysis of the mechanical testing results in Table 1 show the alloying elements which have the strongest negative effects on Charpy impact energy tested on 5 mm U-notch samples with all Charpy impact energy testing performed per the BS EN ISO 148-1:2016 standard. For example, 0.5 inch (12.7 mm) square bars with high contents of Si, C, and/or O (MT6850, MT6852) exhibited Charpy impact energies of less than 10 J. Such results enabled formulation of additional samples intended to give a desired strength and ductility in combination with an improved Charpy impact energy.

Example 2

A series of titanium alloy 0.4 lbs. (0.18 kg) button ingots according to the present disclosure were manufactured and converted to 0.5 inch (12.7 mm) square bars by the method used in Example 1 with the exception of aging at 500° C. for 8 hrs. Chemical compositions of the ingots and the results of mechanical testing on the 0.5 inch (12.7 mm) square are shown in Table 2:

TABLE 2

| | AIM (wt %) | | | | | | Analysed (wt %) | | SHT AC + 500° C./8 hr AC MPa | | % Elong.$^n$ | % Elong.$^n$ | | Charpy 5 mm U Notch Absorbed |
|---|---|---|---|---|---|---|---|---|---|---|---|---|---|---|
| Button ID | Al | Fe | V | C | Si | $O_2$ | $O_2$ | $N_2$ | 0.2% PS | UTS | $5.65\sqrt{A}$ | 4D | R in A | Energy (J) |
| 3181 | 1.25 | 0.8 | 7 | 0.03 | 0.08 | 0.16 | 0.158 | 0.006 | 789 | 898 | 21.5 | 25.0 | 64.5 | 42.0 |
| | | | | | | | | | 792 | 896 | 21.5 | 25.0 | 68.5 | |
| 3182 VC | 1.25 | 0.8 | 7 | 0.03 | 0.08 | 0.16 | 0.151 | 0.009 | 705 | 814 | 24.0 | 28.0 | 68.0 | |
| | | | | | | | | | 709 | 821 | 24.0 | 27.0 | 66.5 | |
| 3182 OQ | | | | | | | | | 932 | 1039 | 18.0 | 21.5 | 63.5 | |
| 3183 | 1.1 | 0.65 | 6.75 | — | 0.06 | 0.14 | 0.136 | 0.006 | 719 | 831 | 24.5 | 28.0 | 68.5 | 49.0 |
| | | | | | | | | | 720 | 831 | 25.0 | 28.5 | 68.5 | |
| 3184 | 1.4 | 0.95 | 7.25 | 0.05 | 0.1 | 0.18 | 0.170 | 0.007 | 857 | 955 | 20.5 | 24.0 | 66.0 | 38.5 |
| | | | | | | | | | 852 | 951 | 22.0 | 27.5 | 64.0 | |
| 3185 | 0.95 | 0.55 | 6.5 | — | 0.04 | 0.13 | 0.122 | 0.009 | 672 | 786 | 24.5 | 29.5 | 69.5 | 51.0 |
| | | | | | | | | | 667 | 783 | 25.5 | 29.5 | 66.5 | |
| 3186 | 1.55 | 1.05 | 7.5 | 0.08 | 0.12 | 0.19 | 0.185 | 0.006 | 920 | 1018 | 19.0 | 23.0 | 63.0 | 33.0 |
| | | | | | | | | | 909 | 1004 | 20.5 | 23.5 | 65.0 | |

As shown, the alloys according to the present disclosure exhibit superior combinations of strength, ductility and Charpy impact energy compared with the comparative alloys in Example 1 (Table 1). For example, the average Charpy impact energy for the alloys in Table 2 was 42.7 J compared to an average Charpy impact energy of 19.1 J for the alloys in Table 1. In addition, the alloys subjected to air cooling plus aging at 500° C. for 8 hours (i.e., samples 3181, 3183-3186) have an average 0.2% yield strength (0.2% YS) of 789.7 MPa, an average ultimate tensile strength (UTS) of 895.3 MPa, and an average 4D elongation (%) to failure of 26.4%, compared to the Ti-407 alloys A-1-A-8, A-10-A-17 and A-24 in U.S. Pat. No. 10,000,838 shown in in Table 3 below subjected to the same air cooling plus 500° C. for 8 hours aging treatment that have an average 0.2% YS of 622.5 MPa, an average UTS of 703 MPa and an average 4D percent elongation to failure of 25.3%.

TABLE 3

| Alloy | Composition | 0.2% YS (MPa) | UTS (MPa) | 4D El (%) |
|---|---|---|---|---|
| A-1 | .7Al—3.8V—.25Si—.1Fe | 548 | 612 | 27.5 |
| A-2 | .55Al—3V—.25Si—.25Fe | 559 | 639 | 27.8 |
| A-3 | .8Al—3.9V—.25Si—.08Fe | 622 | 689 | 25.2 |
| A-4 | .75Al—4V—.25Si—.14Fe | 648 | 730 | 25.5 |
| A-5 | 1.05Al—4.4V—.35Si—.17Fe | 748 | 817 | 22.8 |
| A-6 | .9Al—4V—.2Si—.16Fe | 666 | 750 | 23.9 |
| A-7 | 1Al—3.9V—.25Si | 602 | 689 | 25.0 |
| A-8 | 1.1Al—5V—.25Si—.1Fe | 591 | 679 | 24.6 |
| A-10 | .45Al—3.5V—.15Si—.15Fe | 549 | 643 | 27.9 |
| A-11 | .6Al—3.9V—.25Si—.15Fe | 641 | 722 | 25.2 |
| A-12 | .9Al—3.9V—.25Si—.25Fe—0.10O | 603 | 676 | 25.7 |
| A-13 | .9Al—3.9V—.25Si—.25Fe—0.12O | 610 | 676 | 23.9 |
| A-14 | .9Al—3.9V—.25Si—.25Fe—0.14O | 627 | 702 | 25.0 |
| A-15 | .9Al—3.9V—.25Si—.25Fe—0.16O | 650 | 719 | 23.9 |
| A-16 | .9Al—3.9V—.25Si—.25Fe—0.18O | 672 | 750 | 23.8 |

TABLE 3-continued

| Alloy | Composition | 0.2% YS (MPa) | UTS (MPa) | 4D El (%) |
|---|---|---|---|---|
| A-17 | .9Al—3.9V—.25Si—.25Fe—0.20O | 715 | 791 | 24.2 |
| A-24 | 2Al—4V—.25Si—.05Fe | 532 | 668 | 28.5 |

The data from Example 2 also shows samples having the same composition but subjected to different cooling rates and exhibiting significantly different mechanical properties. Particularly, Samples 3181 and 3182 have the same alloy composition (wt. %) of Ti, 1.25 Al, 0.8 Fe, 7.0 V, 0.03 C, 0.8 Si, and 0.16 O. Sample 3181 was solution heat treated (SHT), air cooled (AC) at a cooling rate of 80° C./min, and aged/stress relieved at 500° C., and exhibited an average 0.2% yield strength (0.2% YS) of 790.5 MPa, an average ultimate tensile strength (UTS) of 897 MPa, an average 4D percent elongation to failure of 25.0%, an average percent reduction in area of 66.5%, and an average Charpy U-notch impact energy of 42.0 J. Sample 3182 VC was SHT, vermiculite cooled (VC) at a cooling rate of 30° C./min, aged/stress relieved at 500° C., and exhibited an average 0.2% YS of 707 MPa, an average UTS of 817.5 MPa, an average 4D percent elongation to failure of 27.5%, and an average percent reduction in area of 67.2%. Sample 3182 OQ was SHT, oil quenched (OQ) with a cooling rate of 500° C./min, aged/stress relieved at 500° C., and exhibited a 0.2% YS of 932 MPa, an UTS of 1039 MPa, a 4D percent elongation to failure of 21.5%, and a percent reduction in area of 63.5%. Accordingly, the faster cooling rate for the AC samples (Sample 3181) compared to the VC samples (Sample 3182 VC) resulted in higher strength and lower ductility for the AC samples. Similarly, the faster cooling rate for the OQ samples (Sample 3182 OQ) compared to the AC samples (Sample 3181) resulted in higher strength and lower ductility for the OQ samples.

Example 3

A plurality of titanium alloy 0.4 lbs. (0.18 kg) button ingots according to the present disclosure with a composition (wt. %) of Ti, 0.95 Al, 7.0 V, 0.8 Fe, 0.08 Si, 0.03 C, 0.16 O were manufactured and converted to 0.5 inch (12.7 mm) square bars by the method used in Example 1. The 0.5 inch (12.7 mm) square bars were SHT, cooled via VC, AC or OQ, and then subjected to mechanical testing. Table 4 below shows the mechanical test results for the VC, AC and OQ cooled samples. As shown, the samples exhibit superior combinations of strength, ductility and Charpy impact energy compared with the alloys in Example 1 and confirm the effect of cooling rate from the SHT on the mechanical properties of the alloy.

TABLE 4

| ID | Cooling rate | 0.2% PS | UTS | 5D | 4D | R in A |
|---|---|---|---|---|---|---|
| MT7380 MA7(3) | VC | 669 | 782 | 25.0 | 29.5 | 69.0 |
| MT7381 MA7(4) | VC | 687 | 798 | 23.5 | 28.0 | 67.5 |
| MT7382 MA7(3) | AC | 747 | 857 | 23.0 | 27.5 | 70.5 |
| MT7283 MA7(4) | AC | 756 | 868 | 22.0 | 25.5 | 71.5 |
| MT7284 MA7(3) | OQ | 895 | 1006 | 19.5 | 22.5 | 69.0 |
| MT7285 MA7(4) | OQ | 909 | 1015 | 18.0 | 21.5 | 66.0 |

Particularly, the VC cooled samples (MT7380, MT7381) exhibited an average 0.2% YS of 678 MPa, an average UTS of 790 MPa, an average 4D percent elongation to failure of 28.8%, and an average percent reduction in area of 68.3%. The air cooled (AC) cooled samples (MT7382, MT7283) exhibited an average 0.2% YS of 751.5 MPa, an average UTS of 862.5 MPa, an average 4D percent elongation to failure of 26.5%, and an average percent reduction in area of 71%. The OQ cooled samples (MT7284, MT7285) exhibited an average 0.2% YS of 902 MPa, an average UTS of 1010.5 MPa, an average 4D percent elongation to failure of 22%, and an average percent reduction in area of 67.5%. Accordingly, a faster cooling rate results in an increase in 0.2% YS and UTS and a decrease on 4D percent elongation to failure. Surprisingly, it is noted that AC of the alloy results in an increase in strength and an increase in ductility as measured by percent reduction in area.

Example 4

A series of titanium alloy 0.4 lbs. (0.18 kg) button ingots according to the present disclosure with a composition (wt. %) within the range of the present disclosure (i.e., Ti, 1.0 Al, 7.5 V, 0.7 Fe, 0.02 Si, 0.02 C, 0.15 O) were manufactured and converted to 0.5 inch (12.7 mm) square bars by the method used in Example 1, subjected to a range of processing conditions, and then mechanically tested. Particularly, and as shown in Table 5 below, as-rolled 0.5 inch (12.7 mm) square bars, 0.5 inch (12.7 mm) square bars stress relieved at various temperatures, and 0.5 inch (12.7 mm) square bars that were SHT, cooled via AC and VC, and aged at 500° C. for 8 hrs. were subjected to mechanical testing.

TABLE 5

| | MPa | | % | | | | |
|---|---|---|---|---|---|---|---|
| Processing | 0.2% PS | UTS | Elong.$^n$ $5.65\sqrt{A}$ | Elong.$^n$ 4D | R in A | Charpy 5 mm U (J) | Charpy 2 mm V (J) |
| As rolled | 781 | 896 | 21.5 | 25.5 | 67.0 | 54 | 110.5 |
| Annealed 525° C. 2 hr | 762 | 856 | 21.0 | 24.5 | 65.0 | 59 | 137.5* |
| Annealed 550° C. 2 hr | 757 | 865 | 23.0 | 27.0 | 67.5 | 51 | 104 |
| Annealed 575° C. 2 hr | 729 | 828 | 22.0 | 25.0 | 65.5 | 57.5 | 140.5* |
| Annealed 600° C. 2 hr | 716 | 828 | 24.0 | 27.5 | 66.5 | 54 | 111.5 |
| Annealed 625° C. 2 hr | 713 | 828 | 22.5 | 25.5 | 66.0 | 55.5 | 138 |
| SHT/AC + 500° C./8 hr | 764 | 878 | 23.5 | 27.0 | 71.0 | 47.5 | 79 |
| SHT/VC + 500° C./8 hr | 685 | 801 | 26.5 | 30.0 | 71.5 | 55 | 112 |

*notch radius 0.16 mm

As shown, improved mechanical properties, particularly improved Charpy impact energies, were exhibited by the 0.5 inch (12.7 mm) square bars stress relieved at 525° C., 575° C. and 625° C. for 2 hr. compared with the samples that were SHT, AC or VC, and aged at 500° C. for 8 hr. Accordingly, stress relieving the 0.5 inch (12.7 mm) square bars at a temperature in the range 500° C. to 650° C. enhanced the Charpy impact energy of the alloy by as much as 77% compared to 0.5 inch (12.7 mm) square bars subjected to SHT, AC and aging at 500° C. for 8 hr.

Example 5

A series of 8 inch (203.2 mm) diameter, nominally 56 lbs. (25.4 kg), vacuum arc remelted (VAR) ingots of alloys of the present disclosure and comparative titanium alloys (comparative alloys) were made and converted to 0.5 inch (12.7 mm) thick plates by a combination of beta forging and alpha beta forging and rolling, followed by alpha beta solution treatment at 25° C. below the beta transus temperature for 1 hour (hr.). The 0.5 inch (12.7 mm) plates were SHT, VC, and stress relieved at 550° C. for 4 hrs. The slow cooling via VC was selected to represent material processed on industrial scale, where thicker sections will result in slower cooling rates than those experienced in air cooling of laboratory samples. Table 6 shows the range of alloy compositions within the range of the present disclosure and outside the range of the present disclosure, together with mechanical test results from the plates.

TABLE 6

| | | Chemistry | | | | | | | | Tensile Test Results (avg of 2) | | | | | | | |
|---|---|---|---|---|---|---|---|---|---|---|---|---|---|---|---|---|---|
| | | Wt. % | | | | | | | | MPa | MPa | GPa | % | % | Charpy (J) | | |
| Heat | Chem | Al | O | C | N | V | Fe | Si | | YS | UTS | Mod | 4D El | R in A | U notch | V Notch | |
| V8778 | Aim | 1.00 | 0.16 | 0.03 | | 7.50 | 0.80 | 0.08 | L | 748 | 806 | 101 | 26.5 | 65.5 | 47 | 91 | Inventive |
| | Ingot | 0.90 | 0.162 | 0.033 | 0.006 | 7.20 | 0.74 | 0.08 | T | 766 | 818 | 104 | 26.3 | 59.3 | 50 | 72 | |
| V8779 | Aim | 0.70 | 0.13 | 0.03 | | 7.50 | 0.80 | 0.08 | L | 686 | 750 | 103 | 24.3 | 65.8 | 48 | 78 | Inventive |
| | Ingot | 0.67 | 0.145 | 0.034 | 0.009 | 7.54 | 0.77 | 0.09 | T | 704 | 763 | 105 | 25.5 | 62.0 | 46 | 86 | |
| V8780 | Aim | 1.30 | 0.19 | 0.03 | | 7.50 | 0.80 | 0.08 | L | 779 | 847 | 108.5 | 24.3 | 55.3 | 34 | 45 | Comparative |
| | Ingot | 1.36 | 0.213 | 0.033 | 0.008 | 7.70 | 0.76 | 0.08 | T | 775 | 845 | 109 | 25.3 | 54.0 | 36 | 47 | |
| V8781 | Aim | 1.00 | 0.16 | 0.03 | | 7.00 | 0.60 | 0.08 | L | 694 | 757 | 104.5 | 23.8 | 63.3 | 50 | 77 | Inventive |
| | Ingot | 1.01 | 0.163 | 0.032 | 0.006 | 7.05 | 0.58 | 0.09 | T | 700 | 771 | 106 | 24.5 | 58.5 | 45 | 65 | |
| V8782 | Aim | 1.00 | 0.16 | 0.03 | | 8.00 | 1.00 | 0.08 | L | 741 | 797 | 102 | 25.5 | 69.5 | 44 | 88 | Inventive |
| | Ingot | 0.97 | 0.170 | 0.034 | 0.008 | 8.14 | 0.94 | 0.09 | T | 758 | 819 | 105 | 26.8 | 63.8 | 50 | 94 | |
| V8783 | Aim | 1.00 | 0.10 | 0.03 | | 7.00 | 0.80 | 0.08 | L | 677 | 735 | 105 | 28.0 | 65.0 | 55 | 72 | Inventive |
| | Ingot | 1.01 | 0.121 | 0.033 | 0.007 | 7.12 | 0.75 | 0.09 | T | 692 | 754 | 105 | 27.8 | 62.5 | 53 | 96 | |
| V8784 | Aim | 1.00 | 0.22 | 0.03 | | 7.00 | 0.80 | 0.08 | L | 797 | 853 | 105 | 23.3 | 50 | 29 | 36 | Comparative |
| | Ingot | 0.97 | 0.242 | 0.032 | 0.006 | 7.15 | 0.75 | 0.09 | T | 799 | 855 | 103 | 24.0 | 50.5 | 27 | 35 | |
| V8785 | Aim | 1.30 | 0.19 | 0.08 | | 7.50 | 0.80 | 0.12 | L | 833 | 885 | 111 | 25.3 | 58.3 | 52 | 42 | Inventive |
| | Ingot | 1.44 | 0.178 | 0.085 | 0.002 | 7.58 | 0.72 | 0.12 | T | 787 | 847 | 106 | 24.8 | 49.3 | 36 | 45 | |
| V8786 | Aim | 1.30 | 0.19 | 0.03 | | 7.50 | 0.80 | 0.12 | L | 766 | 826 | 105 | 25.8 | 59.3 | 46 | 61 | Inventive |
| | Ingot | 1.31 | 0.172 | 0.034 | 0.004 | 7.83 | 0.77 | 0.13 | T | 746 | 811 | 106 | 24.8 | 53.5 | 42 | 58 | |
| V8787 | Aim | 0.70 | 0.13 | 0.03 | | 7.00 | 0.60 | 0.08 | L | 630 | 725 | 103 | 23.5 | 60 | 65 | 128 | Inventive |
| | Ingot | 0.73 | 0.126 | 0.033 | 0.003 | 7.21 | 0.57 | 0.09 | T | 622 | 721 | 103 | 25.8 | 63.8 | 63 | 130 | |

As shown, the titanium alloys with compositions within the range according to the present disclosure exhibited a 0.2% YS between 622-787 MPa, a UTS between 721-885, a 4D percent elongation to failure between 23.5-28.0, a percent reduction in area between 49.3-69.6, a U-notch Charpy impact energy between 36-65 J, and a V-notch Charpy impact energy between 42-130 J. In contrast, the titanium alloys outside the range according to the present disclosure exhibited a Charpy U-notch impact energy of less than 36 J. Accordingly, alloys such as V8778, V8782, and V8787 exhibit a 0.2% YS of at least 700 MPa, a UTS of at least 800 MPa, an Elastic Modulus of at least 100 GPa, a 4D percent elongation to failure of at least 20%, a U-notch Charpy impact energy of at least 40 J and a V-notch Charpy impact energy of at least 70 J.

Example 6

Lathe machinability tests were performed on the titanium alloy compositions shown in Table 7 below. Particularly, machinability V15 tests were performed, where V15 refers to the speed of a cutting tool that is worn out within 15 minutes. The feed rate was 0.1 mm/rev, and the radial depth of cut was 2 mm by a variable speed outer diameter turning operation using a CNMG 12 04 08-23 H13A progressive tool insert with C5-DCLNL-35060-12 holder. The role of aluminum content on the deformation mechanism and its effect on machinability is shown in the table below and the titanium alloys prepared according to the present disclosure exhibit a machinability V15 turning benchmark that is greater than 115 m/min which is an improvement of at least 150% compared to the machinability V15 of the conventional Ti-6Al-4V alloy. Thus, the titanium alloys of the present disclosure exhibit an improved processing capability over conventional titanium alloys.

TABLE 7

| Alloy No. | Alloy Composition | Al | V | Si | Fe | O | V15 (m/min) | |
|---|---|---|---|---|---|---|---|---|
| V8772 | 1.2Al—7.1V—.1Si—.8Fe | 1.16 | 7.10 | 0.09 | 0.75 | 0.14 | 130 | Inventive |
| V8773 | 1.3Al—6.8V—.1Si—.6Fe | 1.31 | 6.86 | 0.10 | 0.62 | 0.19 | 125 | Inventive |
| V8754 | 1.9Al—6.8V—.1Si—1Fe | 1.88 | 6.82 | 0.10 | 0.98 | 0.18 | 111 | Comparative |
| V8761 | 3Al—7V—.1Si—.8Fe | 2.85 | 7.05 | 0.10 | 0.77 | 0.16 | 94 | Comparative |
| Ti64 | 6Al—4V | 5.99 | 3.92 | — | 0.14 | 0.16 | 72 | Comparative |

The present disclosure provides titanium alloys with enhanced ductility compared to the Ti-6V-4Al and enhanced strength compared to the Ti-407 alloy. In some forms of the present disclosure, the titanium alloys comprise a 0.2% yield strength between 600 to 850 MPa, an ultimate tensile strength between 700 to 950 MPa, a percent elongation to failure between 20 to 30%, a percent reduction in area between 40 to 80%, a Charpy U-notch impact energy between 30-70 J, and/or a Charpy V-notch impact energy between 40 to 150 J. For example, in one form of the present disclosure, the titanium alloys comprise a 0.2% yield strength between 650 to 850 MPa, an ultimate tensile strength between 750 to 950 MPa, a percent elongation to failure between 22 to 30%, a percent reduction in area between 55 to 75%, and/or a Charpy V-notch impact energy between 60 to 100 J. Accordingly, such titanium alloys may be used in applications where high energy must be absorbed during deformation of the part, including impact, explosive blast, or other forms of shock loading, such as use in an aircraft engine containment casing.

As used herein, the phrase at least one of A, B, and C should be construed to mean a logical (A OR B OR C), using a non-exclusive logical OR, and should not be construed to mean "at least one of A, at least one of B, and at least one of C.

Unless otherwise expressly indicated, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, manufacturing technology, and testing capability.

The terminology used herein is for the purpose of describing particular example forms only and is not intended to be limiting. The singular forms "a," "an," and "the" may be intended to include the plural forms as well, unless the context clearly indicates otherwise. The terms "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

The description of the disclosure is merely exemplary in nature and, thus, examples that do not depart from the substance of the disclosure are intended to be within the scope of the disclosure. Such examples are not to be regarded as a departure from the spirit and scope of the disclosure. The broad teachings of the disclosure can be implemented in a variety of forms. Therefore, while this disclosure includes particular examples, the true scope of the disclosure should not be so limited since other modifications will become apparent upon a study of the drawings, the specification, and the following claims.

What is claimed is:

1. A titanium alloy consisting of (in wt. %) 5.7 to 8% vanadium; 0.5 to 1.50% aluminum; 0.25 to 1.5% iron; 0.1 to 0.2% oxygen; up to 0.15% silicon; up to 0.1% carbon, less than 0.03% nitrogen, incidental impurities, and a balance of titanium.

2. The titanium alloy according to claim 1, wherein vanadium is between 5.9 to 8%.

3. The titanium alloy according to claim 1, wherein vanadium is between 6.1 and 8%.

4. The titanium alloy according to claim 1, wherein the vanadium is between 6.8 to 7.8%; aluminum is between 0.9 to 1.5%; iron is between 0.5 to 1.1%;

oxygen is between 0.12 to 0.19%; and silicon is up to 0.12%.

5. The titanium alloy according to claim 1, wherein vanadium is 7.3%; aluminum is 1.2%; iron is 0.8%; silicon is 0.05%; and oxygen is 0.16%.

6. The titanium alloy according to claim 1 comprising 7.2% vanadium; 1.2% aluminum; 0.8% iron; 0.15% oxygen; 0.05% silicon; and carbon and nitrogen are reduced to impurities.

7. The titanium alloy according to claim 1, wherein the titanium alloy further comprises:

a 0.2% yield strength between 600 to 850 MPa, an ultimate tensile strength between 700 to 950 MPa, a percent elongation to failure between 20 to 30%, a percent reduction in area between 40 to 80%; and at least one of a Charpy U-notch impact energy between 30 to 70 J and a Charpy V-notch impact energy between 40 to 150 J.

8. The titanium alloy according to claim 1, wherein the titanium alloy further comprises:

a 0.2% yield strength between 650 to 850 MPa, an ultimate tensile strength between 750 to 950 MPa, a percent elongation to failure between 22 to 30%, a percent reduction in area between 55 to 75%; and at least one of a Charpy U-notch impact energy between 40 to 60 J and a Charpy V-notch impact energy between 60 to 100 J.

* * * * *